US012253331B2

(12) United States Patent
Contessa

(10) Patent No.: US 12,253,331 B2
(45) Date of Patent: Mar. 18, 2025

(54) SELF-CENTRING DEVICE FOR SUPPORTING SCOPES ON RIFLE RIBS

(71) Applicant: CONTESSA S.R.L., Marcheno (IT)

(72) Inventor: Alessandro Contessa, Marcheno (IT)

(73) Assignee: CONTESSA S.R.L., Marcheno (IT)

( * ) Notice: Subject to any disclaimer, the term of this patent is extended or adjusted under 35 U.S.C. 154(b) by 0 days.

(21) Appl. No.: 18/259,243

(22) PCT Filed: Jan. 11, 2022

(86) PCT No.: PCT/IB2022/050171
§ 371 (c)(1),
(2) Date: Jun. 23, 2023

(87) PCT Pub. No.: WO2022/167873
PCT Pub. Date: Aug. 11, 2022

(65) Prior Publication Data

US 2024/0077281 A1 Mar. 7, 2024

(30) Foreign Application Priority Data

Feb. 4, 2021 (IT) ..... 102021000002441

(51) Int. Cl.
*F41G 1/22* (2006.01)
*F41G 11/00* (2006.01)

(52) U.S. Cl.
CPC ..... *F41G 1/22* (2013.01); *F41G 11/004* (2013.01)

(58) Field of Classification Search
CPC ..... F41G 1/22; F41G 11/003; F41G 11/004; F41G 11/005; F41G 1/387; F41G 1/41; F41G 1/16–1/28
See application file for complete search history.

(56) References Cited

U.S. PATENT DOCUMENTS 4,899,479 A * 2/1990 Sanders ..... F41G 1/16 42/112
5,033,219 A 7/1991 Johnson et al.
(Continued)

FOREIGN PATENT DOCUMENTS

DE 202008003548 U1 6/2008
FR 2778237 A1 11/1999

OTHER PUBLICATIONS

WIPO, European Patent Office as International Search Authority, International Search Report and Written Opinion mailed Oct. 2, 2022 in International Patent Application No. PCT/IB2022/050171, 9 pages.

*Primary Examiner* — Joshua E Freeman
(74) *Attorney, Agent, or Firm* — MASUVALLEY & PARTNERS; Peter Martinez

(57) ABSTRACT

A device for supporting scopes, such as telescopes, holographic, laser, red-dot aiming systems, etc., for rifles equipped with rib, is described. The device comprises a body, on which the scope can be fastened, and a plurality of claws slidably mounted on the body. The claws are movable to be opened and closed in response to the displacements imparted by the user to corresponding thrust elements, through a special adjusting grub screw. The body has a longitudinal axis which is aligned with the optical axis of the scope mounted thereon each time. The displacements of the thrust elements take place along the longitudinal axis, while the displacements of the claws take place toward and away from the longitudinal axis, in a direction orthogonal thereto. The device is self-centring, meaning that the claws are closed on the rifle rib, so that the latter is always aligned precisely on the longitudinal axis.

13 Claims, 2 Drawing Sheets

(56) References Cited

U.S. PATENT DOCUMENTS

| | | | | |
|---|---|---|---|---|
| 5,606,818 | A * | 3/1997 | Hardee | F41G 11/003 42/127 |
| 6,606,813 | B1 * | 8/2003 | Squire | F41G 11/003 42/111 |
| 6,874,269 | B2 * | 4/2005 | Chen | F41G 11/003 42/106 |
| 2004/0128900 | A1 * | 7/2004 | Chen | F41G 11/003 42/148 |
| 2008/0120891 | A1 * | 5/2008 | Wei | F41G 11/003 42/90 |
| 2011/0290968 | A1 * | 12/2011 | Maughan | F41G 11/004 248/231.51 |
| 2012/0210624 | A1 * | 8/2012 | Schneider | F41G 1/387 42/90 |
| 2013/0212923 | A1 | 8/2013 | Schneider et al. | |
| 2014/0033593 | A1 | 2/2014 | Moore, Jr. | |
| 2014/0252187 | A1 * | 9/2014 | Petrovic | F16B 2/185 248/229.16 |
| 2014/0360077 | A1 | 12/2014 | Miller et al. | |
| 2017/0045334 | A1 * | 2/2017 | Yim | F41G 11/003 |
| 2018/0094904 | A1 | 4/2018 | Greenwood | |
| 2018/0202770 | A1 * | 7/2018 | Pniel | F41G 1/16 |
| 2018/0283670 | A1 * | 10/2018 | Galli | F41G 11/003 |
| 2019/0234710 | A1 * | 8/2019 | Batenhorst | F41G 11/004 |

* cited by examiner

SELF-CENTRING DEVICE FOR SUPPORTING SCOPES ON RIFLE RIBS

RELATED APPLICATIONS

This application is the U.S. National Phase of and claims priority to International Patent Application No. PCT/IB2022/050171, International Filing Date Jan. 11, 2022, entitled Self-Centring Device For Supporting Scopes On Rifle Ribs, which claims benefit of Italian Application No. 102021000002441 filed Feb. 4, 2021, both of which are incorporated herein by reference in their entireties.

FIELD OF THE INVENTION

The present invention refers to a device for supporting scopes on rifle ribs, in particular a self-centring supporting device, preferably for ventilated ribs.

State of the Art

In the arms industry, it is known to mount scopes on firearms, in place of the firearm's fixed sights. The scopes can be, e.g., telescopes and fast aiming systems of laser, holographic or red-dot type. For this reason, many firearms are provided with special rails that facilitate the installation of the scopes.

For example, Picatinny rails, originally called MIL-STD-1913 rail in the NATO nomenclature, are known: these are rail supports fastened to the barrel or to the body of firearms, which allow the installation of several accessories, not only scopes but also torches, laser pointers, video cameras, additional handles, etc. The rail consists of a series of grooves transverse to the firearm barrel, which have T-shaped cross-section with pointed right and left ends, i.e. with triangular sections at −45° and +45°, which define an undercut. Thanks to this geometry, the rail allows the sliding and hooking of the accessories by means of special supporting devices provided with claws that can be clamped against the grooves, from the right and the left. The following documents describe some examples: US 2018/094904, US 2014/360077, US 2014/033593.

Another rail known in the sector is the Weaver rail.

As mentioned above, the accessories that can be mounted on the rails are provided with claws; the claws can be moved between an extended position, in which they are distant from each other, and a close position. When the claws are extended, the accessory is slidable along the rail and can be brought by the user to the desired longitudinal position; when the claws are brought close together and locked, the accessory is also locked on the rail and cannot move. Normally, the clamping of the claws takes place through a screw or a lever. The particular triangular section shape of the ends of the grooves of the rail allows to achieve the centring of the accessory with respect to the firearm barrel. This is an important aspect to keep the aim precision.

For example, US 2013/212923 describes a ring for supporting a telescope, which can be hooked to a Picatinny rail.

The rails are used both on short firearms, such as semi-automatic pistols and revolvers, and on long firearms, such as carbines and rifles, but they have the drawback of being bulky and unaesthetic. In fact, they are widely used in carbines and rifles of military origin, that normally are very accessorized in origin, while the application on shotguns, for which aesthetics plays a fundamental role in the market, is less widespread.

Different solutions have therefore been proposed for rifles with respect to the rails described above.

For example, FR 2778237 describes a device for supporting a red-dot aiming system, or more simply a red dot, on carbines and rifles, comprising a bracket which can be screwed directly on the barrel of a carbine. Mounting a bracket directly on the firearm barrel involves quite a few technical difficulties, related to the fact that drilling or stripping material from the barrel in order to make grooves or holes for the screws can lead to the weakening of the same barrel. Even welding brackets or other elements on the barrel is inconvenient because it is an irreversible solution, which does not allow the disassembly.

US 2004/128900 describes a system for retaining accessories on an accessory-holding rail of a firearm, e.g. a Picatinny rail. In the embodiment shown in FIG. 9A and in the following figures, the system comprises scissors-like hinged clamps for tightening simultaneously on the rail.

Other solutions known in the art are described in DE 20 2008 003548U and in U.S. Pat. No. 5,033,219.

Some rifles are provided with a rib, i.e. a metal strip welded to the rifle barrel, at the upper surface, which has the task of supporting the fixed front sight and rear sight of the rifle, i.e. it has the task of identifying the line of sight. Also, some overlapping double-barrelled rifles are provided with the rib on the upper barrel; in other side-by-side-barreled rifles, the rib keeps the barrels together.

The expression ventilated rib identifies a rib lightened with grooves, indentations or windows.

The Applicant has found that in rifles provided with a rib, the space available for the installation of a rail is not sufficient, precisely because the rib extends across the length of the barrel (or barrels).

However, it is desirable to be able to equip rifles provided with rib, with a scope.

SUMMARY OF THE INVENTION

Object of the present invention is therefore to provide a device for supporting scopes on rifles provided with a rib, in particular a supporting device that does not require modifications to the firearm and is simple to position on the rifle and to be removed, without altering the aesthetics and functionality of the firearm and allowing to achieve the same aim precision as the rib.

The present invention therefore concerns a supporting device according to claim 1 for supporting scopes on rifles equipped with a rib.

For the purposes of the present invention, the term "scopes" identifies not only the telescopes but, in general, also other aiming systems, such as holographic, red-dot or laser systems.

In particular, the supporting device according to the present invention comprises a body, one or more thrust elements mounted on the body and at least two claws also mounted on the body.

The body of the device has a longitudinal axis intended to be collimated with the rib and, therefore, intended to define the line of sight of the supported scope, so that the scope mounted on the supporting device is aligned with the rib during the use of the firearm, which in turn defines the line of sight.

The body of the device comprises a surface for supporting a scope, preferably a surface equipped to allow the scope to be easily and interchangeably mounted and dismounted, to use the supporting device with a plurality of scopes.

The longitudinal position of the thrust elements is adjustable by the user, meaning that the thrust elements can be brought by the user to the desired longitudinal position, within the permitted travel, and remain in this position until the user makes a new adjustment.

At least two claws are constrained to each thrust element, so as to be opposite to each other with respect to the longitudinal axis. The claws are movable toward and away with respect to the longitudinal axis, in response to the displacements imparted by the user to the corresponding thrust element. In other words, the claws can be moved between a mutually distal, or open, position, which allows the insertion and sliding of the rifle rib therebetween, and a mutually proximal, or closed, position, which corresponds to the claws clamped on the rib, from sides opposite the flanks of the same rib.

Basically, the claws can be opened and closed like a pliers, to allow the mounting of the supporting device on the rib and, therefore, on the rifle, without this involving structural or aesthetic modifications to the same rifle. By adjusting the longitudinal position of the thrust elements, the user can easily lock the supporting device on the rib, in the desired position, and can likewise dismount the supporting device or displace it to the desired position along the rib and lock it again, and this is done without having to carry out mechanical working operations or modifications of the rifle barrel, rib or other parts of the firearm.

Advantageously, the thrust elements have an axial symmetry with respect to the longitudinal axis and this makes the device self-centring, meaning that the clamping of the rib by the claws occurs with the rib aligned with the longitudinal axis of the device; this way, the automatic alignment of the optical axis of the scope mounted on the supporting device with the rib, is achieved.

The self-centring movement of the claws results from the fact that for any longitudinal position assumed by the respective thrust element, the claws are symmetrically located both at the same distance from the longitudinal axis and therefore the rib clamped between the claws must necessarily be aligned with the longitudinal axis. In other words, the claws move synchronously.

The benefits provided by the proposed solution are various.

First of all, the user can use the supporting device to interchangeably mount one or more scopes on his/her rifle, without having to carry out modifications to the firearm and without having to calibrate the scope each time and check the collimation of the optical axis with the line of sight defined by the rib, thus having the certainty of having a precise sighting system after each replacement.

Secondly, the supporting device allows to mount, on rifles provided with rib, telescopes, holographic, laser, red-dot sighting systems, etc., without permanently modifying the aesthetics of the firearm. The user only has to extend the claws to release the supporting device from the rib and return the firearm to its original configuration.

In the preferred embodiment, the supporting device comprises a first thrust element and corresponding two right and left claws, and comprises a second thrust element and corresponding two right and left claws. The two thrust elements are aligned along the longitudinal axis. A centre-to-centre distance between the two pairs of claws is defined, i.e. the two pairs of claws are located at a certain distance from each other so that they intercept a sufficiently long segment of the rib, e.g. 5 cm.

Preferably, the thrust elements have:

- a central portion, which is coaxial to the longitudinal axis and slidably housed in a corresponding first seat of the body of the device, and
- two projections extending transversely, i.e. with an inclination, with respect to the longitudinal axis; the claws each engage one of these projections so that a longitudinal displacement of the thrust element, and therefore of the projections, causes a transverse displacement of the claw and allows the rib to be clamped.

In the preferred embodiment, for which the Applicant reserves the right to file a divisional patent application, the claws each have an inner guide inclined with respect to the longitudinal axis, and the corresponding projection of the respective thrust element is slidably inserted in this inner guide. Moreover, the body of the supporting device comprises seats of the claws which extend orthogonally with respect to the longitudinal axis. Therefore, the claws are forced to move orthogonally to the longitudinal axis, by sliding in their respective seats, in response to the thrusts imparted by the projections of the thrust elements slidably inserted in the inner guides of the claws.

Preferably, the thrust elements have a central portion coaxial to the longitudinal axis and housed slidably in a corresponding first seat of the body of the supporting device and, for each thrust element, there is a screw or grub screw, for adjusting the longitudinal position, screwed through the body, so as to be accessible from the outside and through the thrust element, in order to impart the movements. Obviously, by screwing or unscrewing the screw or the grub screw, a corresponding (uniquely corresponding) displacement of the thrust element forwards or backwards in the body of the supporting device is achieved. The Applicant reserves the right to file a divisional patent application for the characteristics described in this paragraph.

In an embodiment, for which the Applicant reserves the right to file a divisional patent application, the thrust elements are small Y-shaped blocks, with the central portion arranged coaxial to the longitudinal axis and slidably housed in a corresponding seat of the body of the supporting device, and two projections which extend symmetrically from the central portion, with an angle between 30° and 60°, and preferably equal to 45°, with respect to the longitudinal axis. The projections are slidably inserted in an inner guide of the claws. In the body of the supporting device, seats of the claws, which extend orthogonally with respect to the longitudinal axis, are formed; the claws are inserted in the respective second seats, resulting slidable in a direction orthogonal to the longitudinal axis in response to the thrusts imparted by the projections of the Y-shaped thrust elements.

Basically, the combined movement of the thrust elements along the longitudinal axis and the respective projections in the inner guides of the claws, along a direction inclined with respect to the longitudinal axis, causes the displacements of the claws in their respective seats of the body of the supporting device, in a direction orthogonal to the longitudinal axis.

Preferably, the surface for supporting the scope is a removable plate, which can be fastened to the body on top. The removable plate has holes for fastening holographic, laser or red-dot aiming systems, or for fastening rings for retaining telescopes.

Preferably, the claws are made of steel and are equipped with a portion of brass or other material, provided that it is less tough than the material of the rib, i.e. they are made of two pieces, or a coating made of brass at the surface for resting against the rib. The ribs are usually made of mild steel, and the use of brass or other material ensures that the rib is not damaged when the claws are clamped against it.

Preferably, the supporting device is intended for use with ventilated ribs, i.e. lightened ribs, provided with windows. These ribs usually have a T-shaped or double T-shaped profile. In order to effectively clamp the ventilated rib, the claws are preferably shaped with a lower edge protruding with respect to the lateral profile of the claw so that the edge, together with the rib, defines an undercut which prevents the accidental removal of the supporting device.

BRIEF LIST OF THE FIGURES

Further characteristics and advantages of the invention will become clearer in the review of the following detailed description of a preferred, although not exclusive, embodiment, illustrated by way of example and without limitations with the aid of the accompanying drawings, in which.

DETAILED DESCRIPTION OF THE INVENTION

Figure 1:
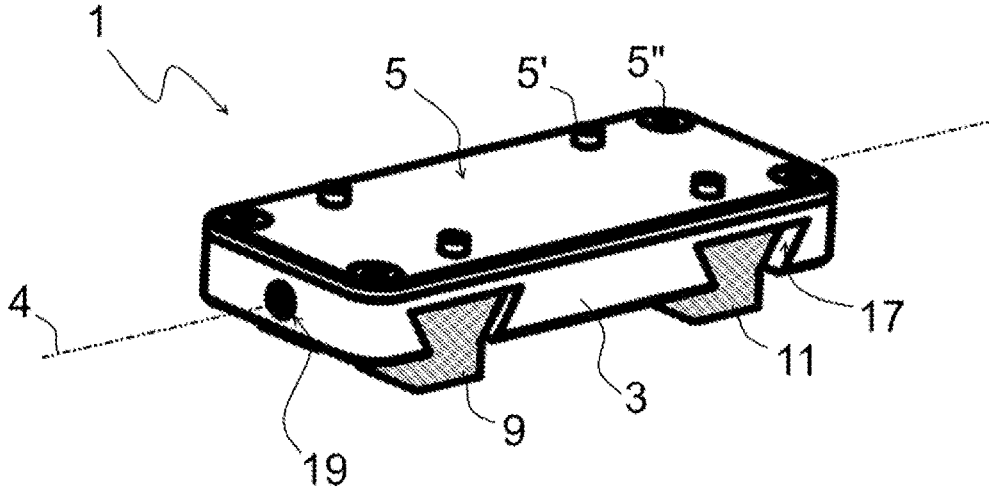
FIG. 1 is a perspective view of a supporting device according to the present invention.

The accompanying FIGS. 1-4 show a supporting device 1 according to the present invention, comprising a body 3, preferably of steel, intended to be removably hooked to a rib 2 of a rifle, preferably a ventilated rib 2.

The body 3 has a longitudinal axis 4 which, during the use of the rifle and the supporting device 1, is aligned with the rib 2 and, therefore, with the line of sight of the firearm.

In the example shown in the figures, the body 3 houses two thrust elements 6, 7 aligned on the longitudinal axis 4 and movable along said longitudinal axis 4, in both directions, in corresponding seats 13. In general, however, the supporting device 1 comprises at least one thrust element 6, 7, preferably two.

The longitudinal displacement of the thrust elements 6 and 7 is controlled by a corresponding adjusting screw or grub screw 19 screwed both through the body 3 of the device 1 and through the same thrust element 6, 7, just along the longitudinal axis 4. The clockwise/counter-clockwise rotation of the adjusting screw or grub screw 19 causes the forward or backward displacement of the corresponding thrust element 6, 7 in its seat 13.

Each thrust element 6, 7 comprises a central portion 12, which is slidably housed in the seat 13 of the body 3, so as to be coaxial to the longitudinal axis 4. Through the adjusting screw or grub screw 19, the user inserts the respective thrust element 6, 7 in the seat 13, or extracts it, until the thrust element 6, 7 reaches the desired position, where it remains locked until it is readjusted.

Two projections 14, 15 extend from the central portion 12 of each thrust element 6, 7 in a transverse direction with respect to the longitudinal axis 4, preferably a direction which forms an angle between 30° and 60° with the longitudinal axis 4 and more preferably of 45° as in the example shown. As can be seen from the figures, this configuration corresponds to a Y-shape of the thrust elements 6, 7, which is clearly visible especially in FIG. 3.

The thrust elements 6 and 7 just described are symmetrical with respect to the longitudinal axis 4, i.e. they have axial symmetry and this characteristic, as will now be explained, allows to achieve the self-centring function of the supporting device 1.

The supporting device 1 comprises two claws 8-9 and 10-11 for each of the thrust elements 6, 7. In the example shown in the figures, therefore, there are four claws 8-11, two left claws 8 and 10 and two right claws 9 and 11. The claws 8-11 engage the projections 14, 15 of the respective thrust element 6, 7: in particular,

- the first left claw 8 engages the right projection 14 of the first thrust element 6;
- the first right claw 9 engages the left projection 15 of the first thrust element 6;
- the second left claw 10 engages the left projection 14 of the second thrust element 7;
- the second left claw 11 engages the left projection 15 of the second thrust element 7.

The coupling between the projections 14-15 and the respective claws 8-11 is of the sliding type: the claws 8-11 are each provided with an inner guide seat 16, which is oriented so as to have, with respect to the longitudinal axis 4, the same inclination as the corresponding projection 14 and 15 of the thrust element 6, 7. The projections 14 and 15 are slidably inserted in the inner guide 16 of the respective claw 8-11.

The body 3 of the supporting device 1 comprises, for each of the claws 8-11, a corresponding sliding seat 17, in which the claw 8-11 is moveable in both directions. The seats 17 are oriented orthogonal to the longitudinal axis 4 and, therefore, the claws 8-11 are constrained to move exclusively toward the longitudinal axis 4, to close against the rib 2 and clamp it, and away from the longitudinal axis 4, to release the rib 2 and disengage the supporting device 1 from the rifle.

Figure 3:
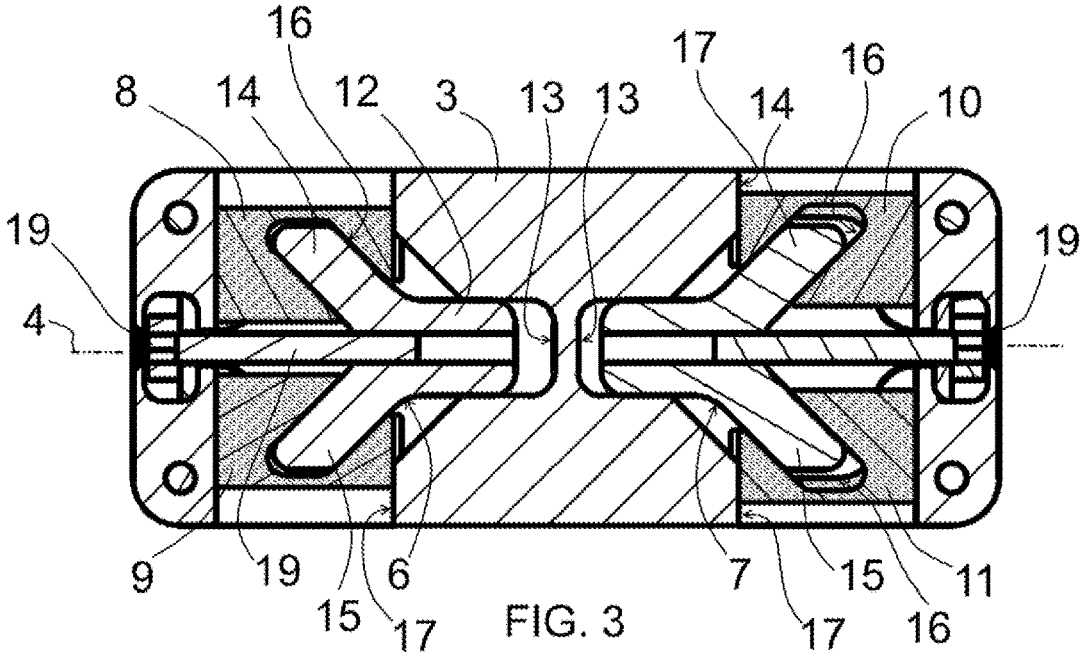
FIG. 3 is a plan and sectional view of the supporting device shown in FIG. 1.

The described configuration allows to achieve this operation: observing FIG. 3 when the user, by rotating the adjusting screw 19, displaces the thrust element 6 toward the right, causes the at least partial insertion of the central portion 12 in the seat 13, and the projections 14 and 15, moving toward the right, apply a thrust to the claws 8 and 9 which results in the outward sliding of the claws 8 and 9 in the seats 17, i.e. for their opening (the claws 8 and 9 are spread apart), by virtue of the sliding of the projections 14 and 15 in the inner guides 16 of the claws 8 and 9 on 45°-inclined planes. Vice versa, when the user, by rotating the adjusting screw 19, displaces the thrust element 6 toward the left, causes the at least partial extraction of the central portion 12 from the seat 13, and the projections 14 and 15, moving toward the left, apply a thrust on the claws 8 and 9 which results in the inward sliding of the claws 8 and 9 in the seats 17, i.e. for their closing (the claws 8 and 9 move close to each other), by virtue of the sliding of the projections 14 and 15 in the inner guides 16 of the claws 8 and 9 on 45°-inclined planes.

The same takes place for the other thrust element 7 with the respective claws 10 and 11.

Since the projections 14 and 15 of the thrust elements 6, 7 are identical and symmetrical with respect to the longitudinal axis 4, the claws 8-9 and 10-11 move synchronously and are always located at the same distance from the longitudinal axis 4 for each position of the respective thrust element 6, 7. This is why the supporting device 1 can be defined as self-centring.

Figure 2:
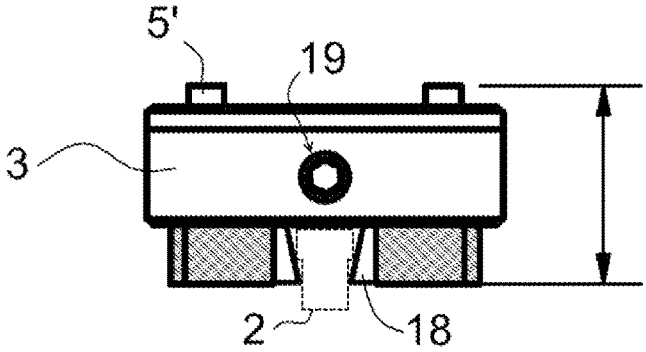
FIG. 2 is a front elevation view of the supporting device shown in FIG. 1.

The consequence is that the rib 2 clamped by the claws 8-11 is always aligned automatically with the longitudinal axis 4, as shown in FIG. 2, when the user clamps it. This is a great advantage because the aim precision is guaranteed, considering that even the optical axis of the scope supported by the device 1 is always aligned with the longitudinal axis 4 and, therefore, aligned with the rib 2.

The scopes can be mounted on the upper surface 5 of the body 3 of the device 1. Such surface 5 is preferably, as well shown in FIG. 4, a removable plate screwed to the body 3. The plate 5 is provided with projections 5' and/or holes 5" for fastening the scopes, or alternatively dovetail rails, grooves, etc. The plate 5 is interchangeable in order to allow the mounting of different scopes on the device 1, depending on the shooter's needs at the time. Obviously, all the scopes mounted each time will be perfectly centred, i.e. aligned, as described above.

Figure 4:
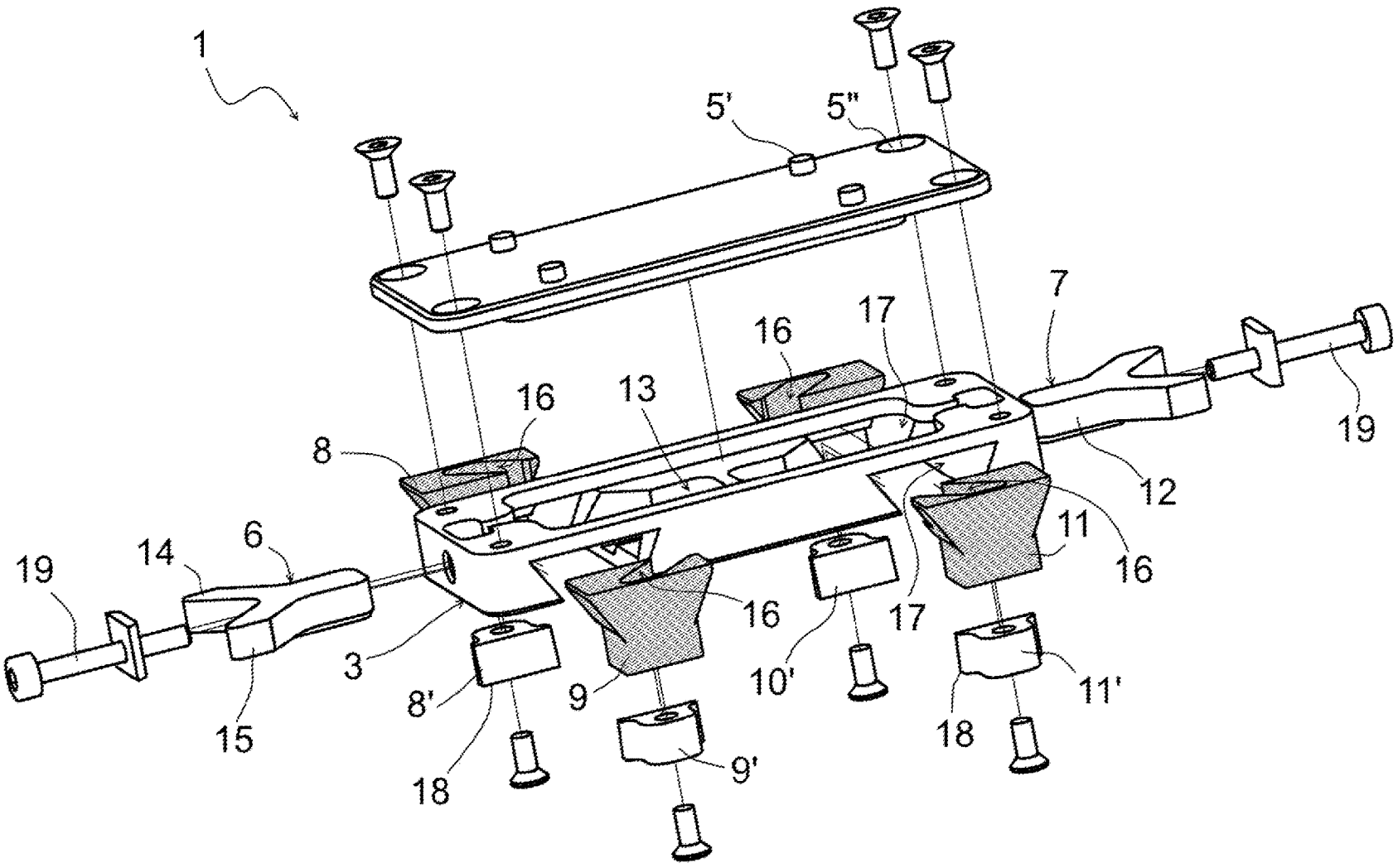
FIG. 4 is an exploded view of the supporting device shown in FIG. 1.

With reference to FIG. 4, the claws 8-11 are preferably made of steel, like the body 3, but in order to avoid damaging the rib 2, a portion 8', 9', 10' 11' of the claws 8-11—precisely the one that contacts the rib—is made of brass. These are, basically, blocks screwed to each other. Alternatively, the claws 8-11 are entirely made of brass or other material or are at least partially coated with brass.

With reference to FIGS. 2 and 4, the claws 8-11 have a lower edge 18 which protrudes, with respect to the inner face of the respective claw 8-11, toward the longitudinal axis 4, to create an undercut with the rib 2. In fact the ribs 2, especially the so-called ventilated ribs, have a substantially T-shaped cross-section, and the edges 18 of the claws 8-11 engage under the horizontal portion of the T in order to maximise the seal, i.e. to ensure the grip effectiveness, so that the supporting device 1 does not move even when the rifle recoil and jump are considerable.

The invention claimed is:

1. A device for supporting scopes on a rifle having a rib, comprising:

a body, having a longitudinal axis and a surface for supporting a scope, and one or more thrust elements mounted on the body, whose longitudinal position is adjustable by the user, at least two claws mounted on the body and constrained to a corresponding thrust element, which are opposed one another with respect to the longitudinal axis, wherein the claws are movable toward and away with respect to the longitudinal axis, in response to the displacements imparted by the user to the corresponding thrust element and can be clamped on the rib of the rifle, and wherein the thrust elements have axial symmetry with respect to the longitudinal axis and the clamping of the rib by the claws takes place with the rib aligned with said longitudinal axis, wherein the thrust elements have:

a central portion, coaxial to the longitudinal axis and slidingly housed in a corresponding first seat of the body, and two projections, which extend transversely to the longitudinal axis, and wherein the claws engage said projections, wherein the claws each have an inner guide and the corresponding projection of the respective thrust element is slidably inserted in said inner guide, and the body comprises second seats of the claws, and wherein said second seats extend orthogonally to the longitudinal axis and the claws are inserted in the respective second seats, thus being slidable in a direction orthogonal to the longitudinal axis.

2. The device according to claim 1, wherein the movement imparted by the thrust element to the corresponding claws is synchronised, meaning that for any longitudinal position taken by the respective thrust element, the corresponding claws are located one at the same distance from the longitudinal axis as the other and the device is thus self-centring.

3. The device according to claim 1, comprising a first thrust element and corresponding two claws and comprising a second thrust element and corresponding two claws.

4. The device according to claim 1, wherein the thrust elements have a central portion coaxial to the longitudinal axis and slidably housed in a corresponding first seat of the body, and the device comprises, for each thrust element, an adjusting screw or grub screw for adjusting the longitudinal position, which is screwed through the body and through the thrust element.

5. The device according to claim 1, wherein the thrust elements are Y-shaped, with a central portion arranged coaxial to the longitudinal axis, and slidably housed in a corresponding first seat of the body and two projections which extend symmetrically from the central portion, with an angle between 30° and 60°, and preferably 45°, with respect to the longitudinal axis, and wherein said projections are slidably inserted in an inner guide of the claws, and wherein the body comprises second seats of the claws, and said second seats extend orthogonally to the longitudinal axis and the claws are inserted in the respective second seats, thus being slidable in a direction orthogonal to the longitudinal axis in response to the thrusts imparted by said projections.

6. The device according to claim 1, wherein the surface for supporting a scope is a removable plate, which can be fastened to the body at its upper portion and has holes for fastening holographic, laser or red-dot aiming systems, or for fastening rings for retaining telescopes.

7. The device according to claim 1, wherein the claws are made of brass, or are made of steel and are equipped with a portion made of brass or a coating made of brass or other material at the surface resting against the rib.

8. The device according to claim 1, wherein the claws have a lower edge which defines an undercut when it abuts against a ventilated rib.

9. Use of the device of claim 1 for removably locking a telescope or holographic, laser or red-dot aiming systems on a rib of a rifle, preferably a ventilated rib.

10. A device for supporting scopes on a rifle having a rib, comprising:

a body, having a longitudinal axis and a surface for supporting a scope, and one or more thrust elements mounted on the body, whose longitudinal position is adjustable by the user, at least two claws mounted on the body and constrained to a corresponding thrust element, which are opposed one another with respect to the longitudinal axis, wherein the claws are movable toward and away with respect to the longitudinal axis, in response to the displacements imparted by the user to the corresponding thrust element and can be clamped on the rib of the rifle, and wherein the thrust elements have axial symmetry with respect to the longitudinal axis and the clamping of the rib by the claws takes place with the rib aligned with said longitudinal axis, wherein the thrust elements have a central portion coaxial to the longitudinal axis and slidably housed in a corresponding first seat of the body, and the device comprises, for each thrust element, an adjusting screw or grub screw for adjusting the longitudinal position, which is screwed through the body and through the thrust element.

11. A device for supporting scopes on a rifle having a rib, comprising:

-a body, having a longitudinal axis and a surface for supporting a scope, and one or more thrust elements mounted on the body, whose longitudinal position is adjustable by the user, at least two claws mounted on the body and constrained to a corresponding thrust element, which are opposed one another with respect to the longitudinal axis, wherein the claws are movable toward and away with respect to the longitudinal axis, in response to the displacements imparted by the user to the corresponding thrust element and can be clamped on the rib of the rifle, and wherein the thrust elements have axial symmetry with respect to the longitudinal axis and the clamping of the rib by the claws takes place with the rib aligned with said longitudinal axis, wherein the thrust elements are Y-shaped, with a central portion arranged coaxial to the longitudinal axis, and slidably housed in a corresponding first seat of the body and two projections which extend symmetrically from the central portion, with an angle between 30° and 60°, and preferably 45°, with respect to the longitudinal axis, and wherein said projections are slidably inserted in an inner guide of the claws, and wherein the body comprises second seats of the claws, and said second seats extend orthogonally to the longitudinal axis and the claws are inserted in the respective second seats, thus being slidable in a direction orthogonal to the longitudinal axis in response to the thrusts imparted by said projections.

12. A device for supporting scopes on a rifle having a rib, comprising:

a body, having a longitudinal axis and a surface for supporting a scope, and one or more thrust elements mounted on the body, whose longitudinal position is adjustable by the user, at least two claws mounted on the body and constrained to a corresponding thrust element, which are opposed one another with respect to the longitudinal axis, wherein the claws are movable toward and away with respect to the longitudinal axis, in response to the displacements imparted by the user to the corresponding thrust element and can be clamped on the rib of the rifle, and wherein the thrust elements have axial symmetry with respect to the longitudinal axis and the clamping of the rib by the claws takes place with the rib aligned with said longitudinal axis, wherein the surface for supporting a scope is a removable plate, which can be fastened to the body at its upper portion and has holes for fastening holographic, laser or red-dot aiming systems, or for fastening rings for retaining telescopes.

13. A device for supporting scopes on a rifle having a rib, comprising:

a body, having a longitudinal axis and a surface for supporting a scope, and one or more thrust elements mounted on the body, whose longitudinal position is adjustable by the user, at least two claws mounted on the body and constrained to a corresponding thrust element, which are opposed one another with respect to the longitudinal axis, wherein the claws are movable toward and away with respect to the longitudinal axis, in response to the displacements imparted by the user to the corresponding thrust element and can be clamped on the rib of the rifle, and wherein the thrust elements have axial symmetry with respect to the longitudinal axis and the clamping of the rib by the claws takes place with the rib aligned with said longitudinal axis, wherein the claws are made of brass, or are made of steel and are equipped with a portion made of brass or a coating made of brass or other material at the surface resting against the rib.

* * * * *